US006161332A

United States Patent [19]

Avôt

[11] Patent Number: 6,161,332

[45] Date of Patent: Dec. 19, 2000

[54] PROTECTIVE CONTAINER FOR A POTLIKE OR BOXLIKE CONTAINER

[75] Inventor: Bernardus Johannes Martinus Maria Avôt, The Hague, Netherlands

[73] Assignee: Avot Beheer B.V., The Hague, Netherlands

[21] Appl. No.: 09/269,732

[22] PCT Filed: Oct. 7, 1997

[86] PCT No.: PCT/NL97/00556

§ 371 Date: Jun. 7, 1999

§ 102(e) Date: Jun. 7, 1999

[87] PCT Pub. No.: WO98/15213

PCT Pub. Date: Apr. 16, 1998

[30] Foreign Application Priority Data

Oct. 7, 1996 [NL] Netherlands ..... 1004215

[51] Int. Cl.[7] ..... A01G 25/00; A01G 9/02

[52] U.S. Cl. ..... 47/81; 47/75; 47/65.5

[58] Field of Search ..... 47/65.5, 65.6, 47/67, 68, 72, 75, 81; 220/4.26, 4.27, 4.28; 414/788.2; 206/514

[56] References Cited

U.S. PATENT DOCUMENTS

| | | | |
|---|---|---|---|
| 3,243,919 | 4/1966 | Carlson | 47/38 |
| 3,800,469 | 4/1974 | Lau, Jr. et al. | 47/65.5 |
| 3,965,616 | 6/1976 | Ridgeway | 47/65.5 |
| 4,548,348 | 10/1985 | Clements | 206/514 |
| 5,231,794 | 8/1993 | Weder et al. | 47/72 |
| 5,282,335 | 2/1994 | Holtkamp, Jr. | 47/81 |
| 5,375,371 | 12/1994 | Wells | 47/81 |

FOREIGN PATENT DOCUMENTS 0415854 3/1991 European Pat. Off. .

*Primary Examiner*—Peter M. Poon
*Assistant Examiner*—Elizabeth Shaw
*Attorney, Agent, or Firm*—Jacobson, Price, Holman & Stern, PLLC

[57] ABSTRACT

A protective container for a potlike or boxlike container capable of receiving plants, flowers, bulbs, fruits and the like and provided with a closed tubular wall ending in an outwardly extending flange and with a lower wall having openings, wherein the protective container is provided with a closed circumferential wall ending in an outwardly extending collar edge and a bottom wall without openings and is manufactured from a resilient plastics material, wherein the container and the protective container are coupled relative to each other by an annular element manufactured from a resilient material and comprising an annular wall in which at least two circumferentially extending slots are provided, each for receiving a part of both the collar edge and the flange lying thereon.

12 Claims, 2 Drawing Sheets

PROTECTIVE CONTAINER FOR A POTLIKE OR BOXLIKE CONTAINER

The invention relates to a protective container for a potlike or boxlike container capable of receiving plants, flowers, bulbs, fruits and the like and provided with a substantially closed tubular wall ending in a free upper edge having an outwardly extending flange and with a lower wall having openings, wherein the protective container is provided with a substantially closed circumferential wall ending in a free circumferential edge and a bottom wall without openings and is manufactured from a resilient plastics material, wherein locking means are provided capable of coupling the protective container and the container relative to each other.

Such protective container is known from EP-A1-0 415 854, in the form of a decorative pot for a growth pot in which a plant is grown. Such decorative pot does not only have an aesthetic function, but also serves for receiving soil and water, usually coming from the holes that are always present in the bottom of the growth pot proper. In this manner, fouling problems in the path from grower to consumer at home can be solved. To prevent the protective container from becoming detached from the growth pot inadvertently, as a consequence of which the above fouling problems could as yet occur, locking means are provided in the form of a projection edge provided on the inner face of the protective container adjacent the free circumferential edge thereof. The projection edge has an inside diameter smaller than the outside diameter of the outwardly extending flange of the growth pot, so that after the growth pot has been pressed into the decorative pot, this growth pot, when moving upwards again relative to the decorative pot, has its flange striking the projection edge. This movement is possible because the growth pot and the decorative pot are dimensioned so that the growth pot can lower into the decorative pot through some distance beyond the projection edge, so that the growth pot can also be pressed into the decorative pot if for instance soil is present between the two pots. However, this play, which enables movement between the two pots, also entails the possibility of the two pots becoming detached from each other unintentionally, for instance if the decorative pot is clamped in a transport tray and the growth pot with soil and plant starts to vibrate or move during transport, on account of mass inertia. A growth pot loosened by vibration may then tilt relative to the decorative pot, with all its adverse consequences. The above-mentioned play may also have as a consequence that the protective container stays behind in the tray when the plant is taken or pulled from the tray, so that the above fouling problems could as yet occur. A similar problem may occur when products such as bulbs or fruits are accommodated in a boxlike container with protective container.

It is the object of the invention to solve the above problems in a relatively cheap and simple manner.

According to the invention, this object is attained with a protective container of the type described in the opening paragraph if at the free circumferential edge, an outwardly extending collar edge is provided which can be brought into abutting contact with the flange of the container, and the locking means comprise an annular element manufactured from a resilient material and comprising an annular wall which can be slid connectingly around at least the area of the circumferential wall adjacent the free circumferential edge, wherein at least two circumferentially extending slots are provided in the annular wall, each slot serving to receive a part of both the collar edge and the flange lying thereon.

Owing to these features, there is provided a relatively cheap possibility of coupling the protective container to the container without play, while a compensation possibility for material located between the two containers is maintained, that is to say, if soil or other material should fall from the container into the protective container during insertion of the container into the protective container, this need not hinder the desired coupling between the two containers. As the protective container can be coupled without play to the container, the combination of protective container and container can be handled just as easily, also mechanically or semimechanically, as the container (with contents) alone.

Moreover, the outward appearance of the product to be sold can be improved and embellished by the protective container. Further, the protective container offers the possibility of providing a barcode on the outside of its bottom wall, enabling the product to be read out and registered at a checkout designed therefor, which does not only improve the efficiency, but also reduces a further risk of fouling which occurs during tilting of the product. Of course, it is also possible to provide the circumferential wall of the protective container with prints, for instance to embellish the outward appearance, or with instructions or suggestions for attendance.

Moreover, by using an annular element for locking, an additional advantage is obtained in terms of manufacturing. The protective container can now be designed in a similar manner as the container, that is to say, an inwardly protruding projection edge, which for instance forms a complicating factor during injection molding, can be omitted.

The annular element can be designed in several manners. In this regard, according to a further embodiment of the invention, it is preferred that the slots are cut in the material of the annular wall and parts of both the collar edge and the flange lying thereon extend through those open slots. By virtue of these features, the coupling can be realized simply by positioning the container into the protective container which need not comprise any further locking means, and by subsequently pulling the annular element around the both of them or by lowering them into the annular element, which need only be provided with a number of simple, open slots. With such a manner of coupling the protective container and the container, additional advantages can further be realized if the container is to receive products which project from the free upper edge of the container for some distance and which should preferably be provided with a further protection or package, such as for instance plants or flowers placed in the container. This additional protection can be realized in a simple manner if, according to a further embodiment of the invention, the annular element forms part of a tubular packing member which continues up to some height above the collar edge. By virtue of this feature, the coupling function is advantageously combined with the packing or protecting function.

Another manner of coupling by means of the annular element can be obtained if the annular element comprises at least one groove which extends circularly in the annular wall and which is bounded on either side by an outward protuberance. The coupling between container and protective container can then be realized by pulling a collar edge and flange, suitable therefor as regards dimensions, over the upper outward protuberance, as a result of which that collar edge and that flange end up in the groove and find support on the lowermost outward protuberance. If such annular element comprises several successive grooves in a slightly tapering annular wall, that annular element is readily rendered suitable for coupling containers and protective containers having various collar edge and flange dimensions.

The path from grower to consumer may take up some time, and may actually take up so much time that the products accommodated in the container, for instance flowers or plants, require intermediate care, for instance watering. This on the one hand requires attention and involves additional operations; on the other hand, it entails again a risk of fouling and/or the packing becoming wet. If, according to a further and particularly preferred embodiment of the invention, the annular element can couple the protective container and the container in such a manner that the lower wall of the container is spaced from the bottom wall of the protective container surrounding the container, a space is created between the lower wall of the container and the bottom wall of the protective container which may serve as a reservoir, in which, according to a further embodiment of the invention, a moisture-absorbing and moisture-releasing material, for instance in the form of a gel or fiberboard, is provided. In that case, the coupling between the protective container and the container is utilized in an additionally advantageous manner through the creation of a care possibility for the products present in the container. It can be further guaranteed that this space is always present if stops are arranged which extend upwards from the bottom wall and on which the lower wall of the container then abuts. For that purpose, it is also possible to provide the circumferential wall with inwardly extending centering and arresting members, for instance in the form of grooves extending over at least a part of the height of the circumferential wall while projecting inwards. Such members also provide a further centering and fixing of the container in the-protective container.

In some plants, such as orchids, root rot may occur if the roots extend into the water. In that kind of cases, it may be provided that the grooves continue into the free circumferential edge. Water present in the space between the lower wall and the bottom wall can then evaporate and escape via those continuous grooves and moisten the plant. In that case, it should of course be provided that the water level in that space remains below the lower wall of the container. This can be checked in a simple manner if a water-level meter, readable from the outside, is arranged adjacent the bottom wall, for instance in the form of a transparent window or a separate level meter incorporated into the wall. Also in the case where no grooves continuing into the free circumferential edge are present, it may be preferred that at least one air hole be provided in the area connecting to the free circumferential edge.

With reference to exemplary embodiments shown in the accompanying drawings, the protective container according to the invention will presently be further clarified and explained. In these drawings.

Figure 1:
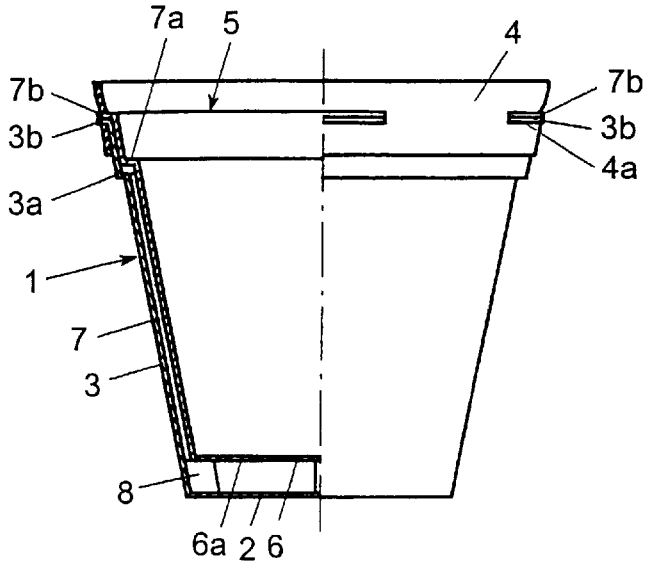
FIG. 1 shows, partly in section and partly in elevation, a first embodiment of the protective container having an annular element which couples and locks the container and the protective container relative to each other.

FIG. 1 shows a protective container 1 comprising a bottom wall 2, to which a circumferential wall 3 connects which diverges conically in upward direction and which has its upper region provided with a step-shaped widening 3*a,* after which the circumferential wall ends in a free circumferential edge to which an outwardly extending collar edge 3*b* connects. Placed in the protective container 1 is a container 5 having a lower wall 6 with openings 6*a,* to which lower wall an upwardly conically diverging wall 7 connects which has its upper region provided with a step-shaped widening 7*a,* after which the circumferential wall ends in an outwardly extending flange 7*b* sitting on the collar edge 3*b*. Provided around the widening 3*a* is an annular part 4 provided with four slots 4*a* which are evenly distributed over the circumference and extend in circumferential direction.

The provision of each slot and the fact that the annular element 4 is bent will cause the relatively short part of the annular element 4 above that slot to spring back inwards slightly. This phenomenon is also relevant for coupling and locking the protective container 1 and the container 5 relative to each other, which container is particularly intended for receiving plants or flowers disposed in potting soil. When the annular element 4 is pulled around the protective container 1 and the container 5, after the free outer edges of the collar edge 3*b* and the flange 7*b* have passed the upper circumferential edge of the annular element, those free outer edges will push the sprung-back part of the annular element 4 above each slot 4*a* outwards. This displacement of the containers 1 and 5 relative to the annular element 4 is continued until parts of a the collar edge 3*b* and the flange 7*b* slip into the slots 4*a,* which is partly enabled by the flexibility of the thin-walled material used for the containers and the annular element, for instance a plastics material whereby, by means of deep drawing, vacuum forming, injection molding or the like, the containers and the annular element can be manufactured. When parts of the collar edge 3*b* and the flange 7*b* slip into the slots 4*a,* the lower sides of those flange parts will abut against the lower edges, likewise slightly sprung inwards, of the slots 4*a,* which have such a height that the outwardly pressed parts of the circumferential wall above the slots 4*a* are released by the collar edge 3*b* and the flange 7*b* and will hence spring inwards again, whereby the parts of the collar edge 3*b* and the flange 7*b* and hence the containers 1 and 5 are locked relative to each other and relative to the annular element 4.

In FIG. 1, four stops 8 are further provided on the bottom wall 2 and, contiguously, on the circumferential wall 3, which stops are dimensioned so that when the collar edge 3*b* and the flange 7*b* engage the slots 4*a,* the lower wall 6 supports on the upper sides of the stops 8. This embodiment is particularly preferred if the contents of the container 5 are relatively heavy.

Figure 2:
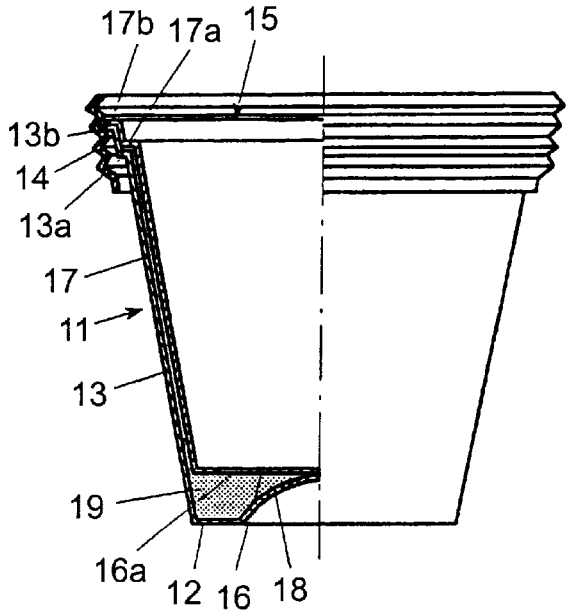
FIG. 2 shows, partly in section and partly in elevation, a second embodiment of the protective container with annular element and container.

FIG. 2 shows a protective container 11 having a bottom wall 12 and a circumferential wall 13 with a step-shaped widening 13*a* and ending in a collar edge 13*b*. The bottom wall 12 comprises an inwardly convex, central part 113, which may act as a springing or non-springing stop and which also allows for the lateral discharge of an excess water dripping from the container. Placed in the protective container is a container 15 provided with a lower wall 16 having openings 16*a,* to which lower wall a tubular wall 17 connects, which diverges conically in upward direction and which has its upper region provided with a step-shaped widening 17*a,* after which the circumferential wall ends in an outwardly extending flange 17*b*. The container 15 has been slid and pressed into the protective container 11 so far that the flange 17*b* rests on the collar edge 13*b*. Provided around the thus interfitted containers 11 and 15 is an annular element 14 in the form of an accordion-shaped locking part which has a number of circumferentially extending grooves whose diameter decreases downwards from the top. The collar edge 13*b* and the flange 17*b* lying on top of each other have been pulled into the annular element 14 in such a manner that they have nested in the groove of the annular element 14 which, as far as their outside diameters are concerned, is the most suitable groove, and the lower wall contacts the central part 18 with or without compression thereof, whereby the coupling and locking between the protective container 11 and the container 15 has been effected.

Provided in the space between the bottom wall 12 and the lower wall 16 is water-absorbing material, such as a gel 19. In this manner, dosed water can be dispensed which can end up, via the openings 16*a,* in the interior of the container 15. In this manner, it is possible to guarantee the care of a plant disposed in the container over a longer period, so that the plant need not be attended to for instance during the grower-consumer path.

Figure 3:
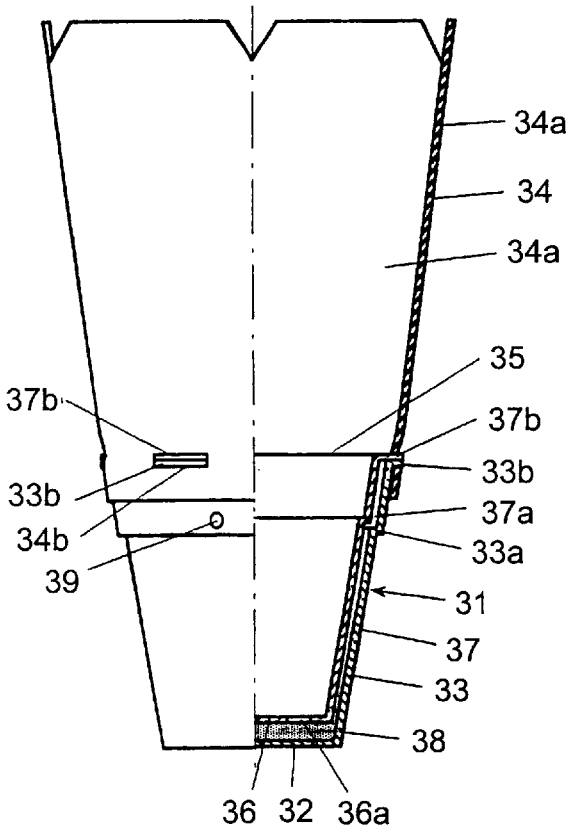
FIG. 3 shows, partly in section and partly in elevation, a third embodiment of the protective container with a container placed therein and an annular element in the form of a tubular package.

FIG. 3 shows a protective container 31 comprising a bottom wall 32 and a circumferential wall 33 having a step-shaped widening 33*a* and ending in an outwardly extending collar edge 33*b*. Disposed in the protective container 31 is a container 35 provided with a lower wall 36 having openings 36*a* and a tubular wall 37 having a step-shaped widening 37*a* and ending in an outwardly extending flange 37*b*. When the container 35 has been inserted into the protective container 31, the flange 37*b* rests on the collar edge 33*b*. The coupling of the protective container 31 to the container 35 is effected by means of an annular element in the form of a tubular package 34 which is formed by six panels 34*a* interconnected by folding lines and manufactured from a light, thin-walled and slightly flexible material, for instance paper, cardboard, plastic or the like. The tubular package is open at its two ends and has a conical configuration adapted to that of the protective container 31 and the container 35, in such a manner that the lower end of the tubular package 34 can connect with close abutment to the upper end of the protective container 31 after adaptation to the round circumferential shape thereof. In that lower-end area, the tubular package is provided with a slot 34*b* which is centrally located in each panel 34*a* and which has such a height that the flange 37*b* and collar edge 33*b,* lying on top of each other, can extend therethrough.

The coupling of the protective container 31 to the container 35 is effected by lowering the interfitted containers into the tubular package 34 from above or by sliding that package over the interfitted containers from below, until parts of the collar edge 33*b* and flange 37*b,* lying on top of each other, come to lie in the slots 34*b,* involving a similar coupling mechanism as discussed with reference to FIG. 1. In this manner, the coupling of the protective container 31 and container 35 is combined in a particularly advantageous manner with a protection or packaging of products accommodated in the container, for instance flowers, plants, flower bulbs or fruits.

In the manner as discussed with reference to FIG. 2, a gel 38 or a fiberboard is arranged between the interfitted protective container 31 and container 35, while the protective container 35 is further provided with an air hole 39.

Figure 4:
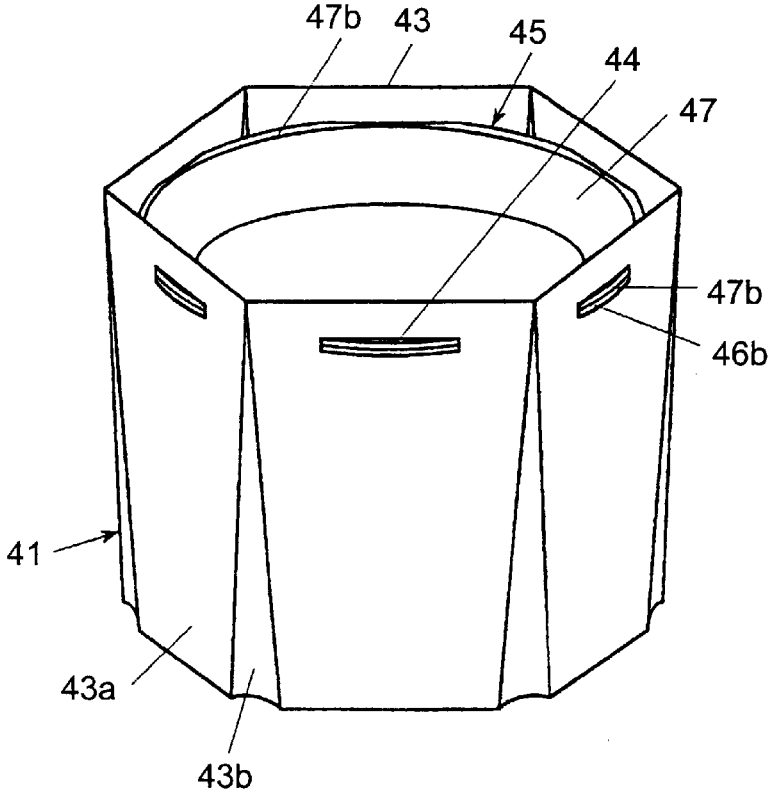
FIG. 4 shows, in perspective, a fourth embodiment of the protective container with a container placed therein and an annular element provided around it.

FIG. 4 shows an annular element 41 having a circumferential wall consisting of six trapezoidal panels 43*a* which are in each case coupled in pairs by triangular panels 43*b* which, relative to the adjoining panels 43*a,* have an inwardly bent shape. The dimensions of the panels 43*a* and 43*b* and the inward convexity of the panels 43*b* are chosen so that the annular element 41 acquires such an inner configuration that a protective container 45 inserted therein has its tubular wall resting against and on the inside of the panels 43*b*. In this manner, a protective container with container 45 placed therein is automatically centered and arrested in the annular element 41 during insertion. For coupling the protective container and the container 45 relative to each other, a circumferentially extending slot 44 is centrally provided in each panel 43*a* adjacent the free circumferential edge 43, through which slot parts of the outwardly extending collar edge 46*b* of the protective container and the flange 47*b* of the container 45 can extend so as to couple the protective container and the container 45 in a manner already discussed hereinabove, wherein the annular element 41 at the location of the collar edge 46*b* and the flange 47*b* is deformed into a substantially circular configuration.

It is readily understood that within the framework of the invention laid down in the appended claims, many modifications are possible. For instance, many other locking and coupling manners are possible for the annular element. The same holds for the construction of the container and/or the protective container. An upward extension of the annular element may also have the shape of parts closing the container or handgrip parts, or a combination of the two. Centering and arresting may also be effected by means of ribs in the protective container, which ribs could for instance be a continuation of the stops 8 depicted in FIG. 1.

What is claimed is:

1. A protective container for a potlike or boxlike container capable of receiving plants, flowers, bulbs, fruits and the like and provided with a substantially closed tubular wall ending in a free upper edge having an outwardly extending flange and with a lower wall having openings, wherein the protective container is provided with a substantially closed circumferential wall ending in a free circumferential edge and a bottom wall without openings and is manufactured from a resilient plastics material, wherein locking means are provided capable of coupling the protective container and the container relative to each other, characterized in that at the free circumferential edge, an outwardly extending collar edge is provided which can be brought into abutting contact with the flange of the container, and the locking means comprise an annular element manufactured from a resilient material and comprising an annular wall which can be slid connectingly around at least the area of the circumferential wall adjacent the free circumferential edge, wherein at least two circumferentially extending slots are provided in the annular wall, each slot serving to receive a part of both the collar edge and the flange lying thereon.

2. A protective container according to claim 1, characterized in that the slots are cut in the material of the annular wall and parts of both the collar edge and the flange lying thereon extend through said open slots.

3. A protective container according to claim 2, characterized in that the annular element forms a part of a tubular package member continuing up to some height above the collar edge.

4. A protective container according to claim 1, characterized in that the locking means comprise at least one groove which extends adjacent and substantially parallel to the free circumferential edge over at least a part of the circumference in the circumferential wall and is bounded on either side by an outward protuberance.

5. A protective container according to claim 1, characterized in that the annular element can couple the protective container and the container in such a manner that the lower wall of the container is spaced from the bottom wall of the protective container surrounding the container.

6. A protective container according to claim 5, characterized in that a moisture-absorbing and moisture-releasing material, for instance in the form of gel or fiber board, is provided on the bottom wall.

7. A protective container according to claim 1, characterized in that stops are provided which extend upwards from the bottom wall.

8. A protective container according to claim 1, characterized in that the circumferential wall comprises inwardly extending centering and arresting members.

9. A protective container according to claim 8, characterized in that the centering and arresting members comprise grooves which, reaching inwards, extend over at least a part of the height of the circumferential wall.

10. A protective container according to claim 9, characterized in that the grooves continue into the free circumferential edge.

11. A protective container according to claim 1, characterized in that adjacent the bottom wall, a water-level meter is provided in the circumferential wall, said water-level meter being readable from the outside.

12. A protective container according to claim 1, characterized in that in the area connecting to the free circumferential edge, at least one air hole is provided.

* * * * *